United States Patent [19]

Kutzner et al.

[11] 4,404,956

[45] Sep. 20, 1983

[54] FURNACE WITH DRAFT-LIMITER AND VENTILATION

[75] Inventors: Luitpold Kutzner, Bosettistrasse 8, D-8000 Munich 60, Fed. Rep. of Germany; Erwin Postenrieder, Mehring, Fed. Rep. of Germany

[73] Assignee: Luitpold Kutzner, Munich, Fed. Rep. of Germany

[21] Appl. No.: 254,087

[22] Filed: Apr. 14, 1981

[30] Foreign Application Priority Data

Apr. 22, 1980 [DE] Fed. Rep. of Germany ..... 3015472

[51] Int. Cl.[3] ..... F23L 3/00

[52] U.S. Cl. ..... 126/293; 126/312

[58] Field of Search ..... 126/293, 312, 285.5; 110/147

[56] References Cited

U.S. PATENT DOCUMENTS

| | | | |
|---|---|---|---|
| 85,931 | 1/1869 | Hessenbruch | 126/293 |
| 208,800 | 10/1878 | Dunklee | 126/293 |
| 440,229 | 11/1890 | Keith | 126/293 |
| 656,895 | 8/1900 | King | 126/312 |
| 1,721,089 | 7/1929 | Reaser | 126/293 |
| 1,943,342 | 1/1934 | Mortimer | 126/293 |
| 1,963,640 | 6/1934 | Alexander | 126/293 |
| 2,009,782 | 7/1935 | Maurer | 126/293 |
| 2,011,103 | 8/1935 | Franz | 126/293 |
| 2,508,885 | 5/1950 | Mackay | 126/293 |
| 3,236,228 | 2/1966 | Hodgins | 126/293 |

*Primary Examiner*—Daniel J. O'Connor

*Attorney, Agent, or Firm*—Toren, McGeady and Stanger

[57] ABSTRACT

In an exhaust gas duct from a furnace a ventilation opening with a ventilation flap is openable in chronological conjunction with the cut-off of the furnace and it is closable in chronological conjunction with the switching on of the furnace. The ventilation opening is formed by a draft-limiter opening located downstream from the furnace and the ventilation flap is formed by a draft-limiter flap. During a pause in furnace operation, the draft-limiter flap is held in an open position independently of the pressure difference prevailing at the draft-limiter flap. One opening and one flap are eliminated. The draft-limiter flap provides the ventilation function as well as the draft-limiter function. If necessary, it can be installed in a small space together with an exhaust gas flap.

27 Claims, 6 Drawing Figures

FURNACE WITH DRAFT-LIMITER AND VENTILATION

The invention concerns a furnace wherein there is connected to the exhaust gas duct after the furnace in the flow direction a ventilation opening with a ventilation flap openable in chronological conjunction with the cut-off of the furnace and closable in chronological conjunction with the switching-on of the furnace, and wherein there is further connected to the exhaust gas duct after the furnace in the flow direction a draft-limiter opening with a draft-limiter flap, whereat this draft-limiter flap is prestressed in the direction of a closing position and is to be opened by the pressure difference incident upon it, p1-p2 (flue draft) between the pressure p2 in the exhaust gas duct and the possibly higher pressure p1 on its outer side, in such a way that when the pressure difference exceeds a predetermined value the draft-limiter flap increasingly opens for the purpose of maintaining a predetermined pressure difference.

Such equipping of furnaces with a ventilation flap and draft-limiter flap is known.

In known arrangements, the ventilation flap is controlled in correlation with an exhaust gas flap in such a way that the ventilation flap opens when the exhaust gas flap closes and vice-versa. The ventilation flap thereat serves to keep up a ventilation of the exhaust gas duct behind the exhaust gas flap, and thus, in particular, a ventilation of the chimney. The ventilation flap is necessary thereat, in particular then, when the exhaust gas flap closes off the exhaust gas duct substantially sealingly, in such a way that a ventilation draft is not maintained through the exhaust gas duct via the exhaust gas flap. The ventilation of the exhaust gas duct and in particular of the chimney is necessary to carry off the humidity appearing in the exhaust gas duct and in particular in the chimney during the operating periods of the furnace and precipitating along the walls. It becomes all the more necessary, the lower the quality of the chimney, because in chimneys of lesser quality, the precipitation of humidity along the walls becomes all the greater due to the greater roughness of the limiting walls of the flue gas duct in the area of the chimney, and the lower-quality insulation. There are, especially in old buildings, chimneys which occasion great humidity deposits during the operating periods of the furnace and in which it is, therefore, especially important to maintain a ventilation through the exhaust gas duct in the inoperative periods.

In the known furnaces of the kind described in the introduction, the likewise already present draft-limiter opening with draft-limiter flap also situated behind the furnace in the direction of flow, is provided in order to limit the flue draft to a predetermined maximum value. In this connection it should be mentioned that the furnaces are adjusted on the basis of a certain flue draft with a view to optimal combustion and optimal thermal efficiency. If this flue draft is exceeded, the efficiency is reduced because the combustion takes place with too great an excess of air. The draft-limiter flap effects a limitation of the flue draft to a certain maximum corresponding to the value set as the basis for the adjustment of the furnace.

A disadvantage in the known furnaces consists in the elaborate construction which is made necessary thereby that at least two flaps, the ventilation flap and the draft-limiter flap and, if necessary, an exhaust gas flap must be present. Added to this, it is frequently difficult to accommodate the ventilation flap and the draft-limiter flap and, if necessary, the exhaust gas flap in the relatively short exhaust gas pipe segments between the furnace and the chimney, so that in the past one regularly placed the draft-limiter flap in the area of a chimney side-wall, which led to all the more elaborate a construction (knocking a hole in the chimney side-wall).

At the basis of the invention there is the task to find in a furnace of the kind described a flap arrangement in which the construction of the flaps is made less elaborate and the entire flap system can, if necessary, be accommodated in a smaller space.

For the solution of this task it is suggested according to the invention that the ventilation opening be formed by the draft-limiter opening and that the ventilation flap be formed by the draft-limiter flap, whereat the draft-limiter flap, during a pause in the operation of the furnace, is held in an opened position independently of the pressure difference prevailing at the draft-limiter flap.

In the construction of the flap arrangement according to the invention there thus is eliminated one opening and one flap. The remaining flap which takes over the ventilation function as well as the draft-limiter function, can, if necessary, be installed in a small space together with an exhaust gas flap.

The draft-limiter flap has already up to now been constructed with a relatively large cross-section so that the through-flow cross-section of the draft-limiter opening is large when the draft-limiter flap is completely open. This large cross-section of the draft limiter opening can be made available, in the solution according to the invention, for the ventilation of the exhaust gas duct and in particular of the chimney. This is especially advantageous because it has been shown that for this ventilation, if it is to be effective for the purpose of a quick drying-out of the chimney, there has to be made available a sizable cross-section, for instance a cross-section in the size of the cross-section of the exhaust gas duct. It is thus a further significant feature of the invention that for the ventilation of the exhaust gas duct there is made available a large ventilation cross-section, for instance on the order of magnitude of the cross-section of the exhaust gas duct.

The solution according to the invention can be used for furnaces with exhaust gas flap as well as for furnaces without exhaust gas flap in the exhaust gas duct. In the arrangement of an exhaust gas flap in the exhaust gas duct, which flap is opened in chronological correlation with the switching-on of the furnace and is closed in chronological correlation with the cut-off of the furnace, the draft-limiter flap can be coupled with the exhaust gas flap in such a way that the draft-limiter flap is held in an open position independently of the pressure difference prevailing at the draft-limiter flap, when the exhaust gas flap is closed.

In this solution—since the ventilation of the exhaust gas duct is guaranteed, when the exhaust gas flap is closed, by the then-opened draft-limiter flap and the exhaust gas flap is therefore not assigned a ventilation function—the exhaust gas flap can be constructed as sealingly as desired, as sealingly, in fact, as it is possible, in devices of the kind under discussion here, with justifiable expenditure from the point of view of manufacturing technology.

An exhaust gas flap which effects a seal in the closed condition is advantageous because the heat losses which in fact are supposed to be avoided according to specification, can be reduced yet substantially by means of a sealing exhaust gas flap. It should be considered in this regard that a ventilation through the exhaust gas flap also goes through the furnace and leads to a cooling-off of the furnace which, especially when it is filled with heat transfer medium, is still at a relatively high temperature after termination of the operation of the furnace and would therefore be cooled off by a ventilation draft through the furnace. By contrast, the ventilation draft which goes through the ventilation flap formed, according to the invention, by the draft-limiter flap, avoids the passage through the furnace. From this point of view the solution according to the invention is also significantly more favorable than furnaces in which the exhaust gas flap, in the closed position, purposely leaves open a certain minimum through-flow cross-section, in order—as demanded for instance in gas furnaces with burners without blowers—to maintain a constant slight ventilation, which is necessary particularly in view of pilot light exhaust gases.

The solution according to the invention is therefore intended especially for such furnaces having burners working with blowers and in which a sufficient ventilation of the combustion chamber is afforded by means of a pre-rinsing device in the burner automat when the exhaust gas flap is open. The invention is adaptable especially to furnaces which along with their exhaust gas ducts do not themselves have any special flow diverters, as are present for example in gas furnaces with burners without blowers, in order to guarantee a combustion independent of the flue draft. These flow diverters as a rule guarantee—no matter whether they are arranged in front of or behind the exhaust gas flap—a sufficient ventilation of the exhaust gas duct through the chimney even when the exhaust gas flap is closed, the point of which is easily seen in the arrangement of the flow diverter behind the exhaust gas flap, and which, in the arrangement of the flow diverter in front of the exhaust gas flap is as a rule guaranteed thereby that in these cases the exhaust gas flap regularly does not close sealingly. From this there results the preferred use of the suggestion of the invention in furnaces constructed without flow diverter.

The invention can furthermore be used especially in such furnaces in which the exhaust gas flap is motor-actuated, for example by means of an electro-motor which, under tension, can constantly be braked to a standstill. Such motor-actuated exhaust gas flaps are present especially in furnaces which are powered with liquid or gaseous fuel, for which reason there results also the special suitability of the arrangement according to the invention for gas and oil furnaces.

This special suitability of the solution according to the invention for furnaces in which the burner works with a blower follows therefrom that for the reasons mentioned above, there is possible in such furnaces a tight sealing of the exhaust gas duct by means of the exhaust gas flap without any adverse effect on the ventilation of the combustion chamber, because the ventilation of the combustion chamber is guaranteed by the pre-rinsing device in the burner automat when the exhaust gas flap is opened.

In the solution according to the invention the exhaust gas flap can be controlled in correlation with the operative condition of the furnace in such a way that it opens before ignition of the burner. This means that before ignition of the burner the ventilation flap can go into a closing position, namely then when the flue draft is not higher than the set predetermined value which is supposed to be maintained by the draft limiter flap. This is, however, a further advantage of the solution according to the invention because the transition of the flow limiter flap into the closing position contributes thereto that before the ignition of the burner there can be a build-up of flue draft which prevents the formation of an exhaust gas backup.

The exhaust gas flap can further be controlled, independently of the operative condition of the furnace, in such a way that it closes with some delay after the switching-off of the burner. This also can be an advantage because the draft-limiter flap then closes with some delay so that the flue draft is maintained long enough for the exhaust gases last formed to disperse.

According to a further development of the invention, the exhaust gas flap and the draft-limiter opening along with the draft limiter flap are for the sake of expediency combined into one structural unit, thus simplifying mounting at the place of installation.

The draft-limiter opening along with the draft-limiter flap can, for example, be arranged at an exhaust gas pipe section situated in the exhaust gas duct between the furnace and a chimney and which also takes up the exhaust gas flap. The draft-limiter flap can, thereat, be arranged in a side pipe projecting from the exhaust gas pipe section, substantially perpendicularly to the axis thereof. The aspiration of offering a compact structural unit with all of the flaps does not preclude arranging the draft-limiter flap in a housing which can be inserted into the side pipe. In this manner it is possible to build in draft-limiter flaps which are also conceived for other useful purposes.

For the mechanical coupling of the exhaust gas flap and the draft-limiter there are numerous possibilities, by means of rods, chains and the like. Because of its special simplicity there is however preferred a solution according to which there is affixed to the exhaust gas flap a take-along member which, in the open position of the exhaust gas flap, is not connected with the draft-limiter flap and which during the opening of the closing flap, enters into engagement with the draft-limiter flap and takes along the latter in its open position.

This latter solution can be especially easily performed in particular then when the exhaust gas flap and the draft-limiter flap are mounted around pivoting axles parallel to each other; one can then construct the take-along member of the exhaust gas flap in the form of a take-along arm extending substantially perpendicularly to the plane of the exhaust gas vent and grasping, with its end, an edge part of the draft-limiter flap situated far from the pivoting axle of the draft-limiter flap, when the exhaust gas flap moves from the open position in the direction of the closing position.

As already suggested, the furnace constructed according to the invention is also conceivable without an exhaust gas flap, for instance then, when the burner is equipped with a combustion air flap which is closed during the operating phases of the furnace or when, in the absence of such a combustion air flap, the combustion air exhaust gas duct through the furnace has such a high flow resistance that when the draft-limiter flap is forced open, the flue ventilation occurs substantially through said draft-limiter flap.

In the absence of an exhaust gas flap, the exhaust gas flap is, of course, no longer available for controlling the draft-limiter flap. Therefore it is suggested for this eventuality that the draft-limiter flap be coupled with an actuating device controlled independently of the operative condition of the furnace in such a way that the draft-limiter flap, during a break in the operation of the furnace, is held in an open position independently of the pressure difference prevailing at the draft-limiter flap.

Further possibilties for the forced opening of the draft-limiter flap during the operation breaks are represented in the claims.

The attached figures elucidate the invention.

Figure 1:
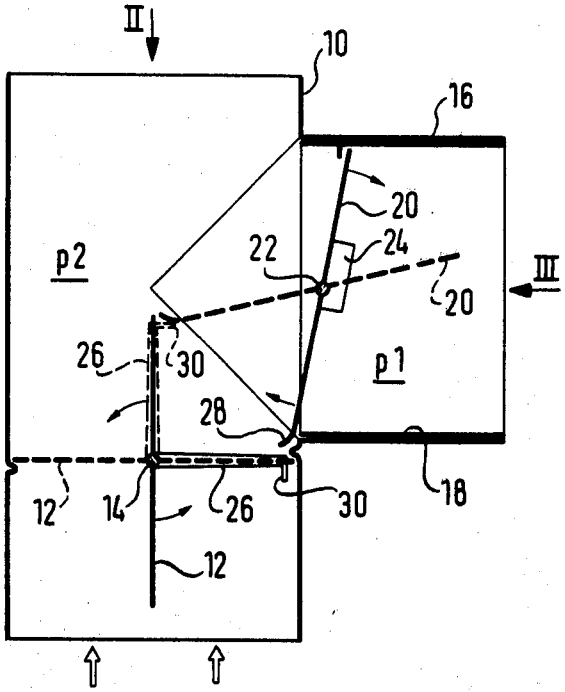
FIG. 1 represents an exhaust gas pipe section with a first embodiment of a flap arrangement according to the invention, in side view.

In FIG. 1, an exhaust gas pipe section is designated by 10. This exhaust gas pipe section, at what is its lower end in FIG. 1, is connected to a furnace not included in the drawing. The upper end in FIG. 1 is connected to a chimney.

Within the exhaust gas pipe section 10 there is arranged an exhaust gas flap 12 which is pivotably mounted around a pivoting axle 14 in the exhaust gas pipe section 10. The exhaust gas flap 12 is drawn with a solid line in the open position and with a broken line in the closed position. At the exhaust gas pipe section 10 there is connected on the side a side pipe 16. The cross-section of the side pipe 16 is approximately as large as the cross-section of the exhaust gas pipe 10. The side pipe 16 is connected to the atmosphere in the space accommodating the furnace, that is to say, open to this space. Into the side pipe 16 there is inserted a pipe-shaped housing 18. This pipe-shaped housing 18 receives a draft-limiter flap 20 which is pivotably mounted around a pivoting axle 22. The draft-limiter flap 20 is weighted with a preferably adjustable weight 24 which prestresses the draft-limiter flap 20 in the direction of the position drawn with a solid line in FIG. 1.

On the exhaust gas flap 12 there is arranged a take-along arm 26 extending perpendicularly to the plane of the exhaust gas flap 12 and positioned, in the open position of the exhaust gas flap 12, substantially horizontally and there reaching under an edge part 28 of the draft-limiter flap 20 without touching it. When the exhaust gas flap 12 goes over into the closing position drawn with a broken line in FIG. 1, then the take-along arm 26 knocks against the edge part 28 of the draft-limiter flap 20 with its end 30 and leads the draft-limiter flap 20 over into the position drawn with a broken line in FIG. 1.

When the take-along arm 26 is out of engagement with the draft-limiter flap 20, the draft-limiter flap reacts to the pressure difference p1-p2, p1 being the atmospheric pressure to the right of the draft-limiter flap 20 and p2 the pressure inside the exhaust gas duct. When the pressure difference p1-p2 exceeds a predetermined set value, then the draft-limiter flap 20 is pivoted clockwise against the action of the weight 24, that is to say, it is opened, so that the pressure p2 can rise and the pressure p1-p2, that is to say, the flue draft is regulated to a constant value.

Figure 2:
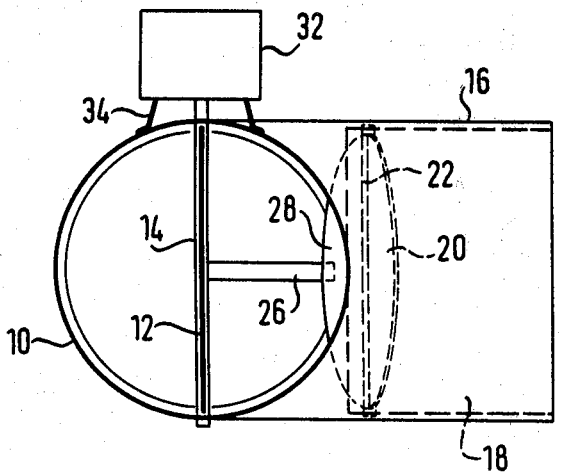
FIG. 2 shows a top view onto the arrangement according to FIG. 1 in the direction of the arrow II of FIG. 1.

As can be seen in FIG. 2, there is attached at the exhaust gas pipe section 10 a drive unit 32 by means of a mounting support 34.

Figure 3:
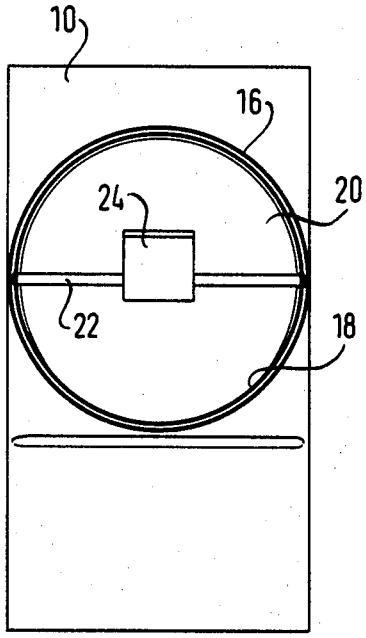
FIG. 3 shows a view turned by 90° in relation to FIG. 1, in the direction of the arrow III of FIG. 1.

The totality of the parts represented in the FIGS. 1 to 3 thus constitutes one structural unit which can be built-in as a whole at the place of assembly, though it is possible to insert into the side pipe 16 the pipe-shaped housing 18 for its part, with the draft-limiter flap 20, as prefabricated infrastructural unit.

Figure 4:
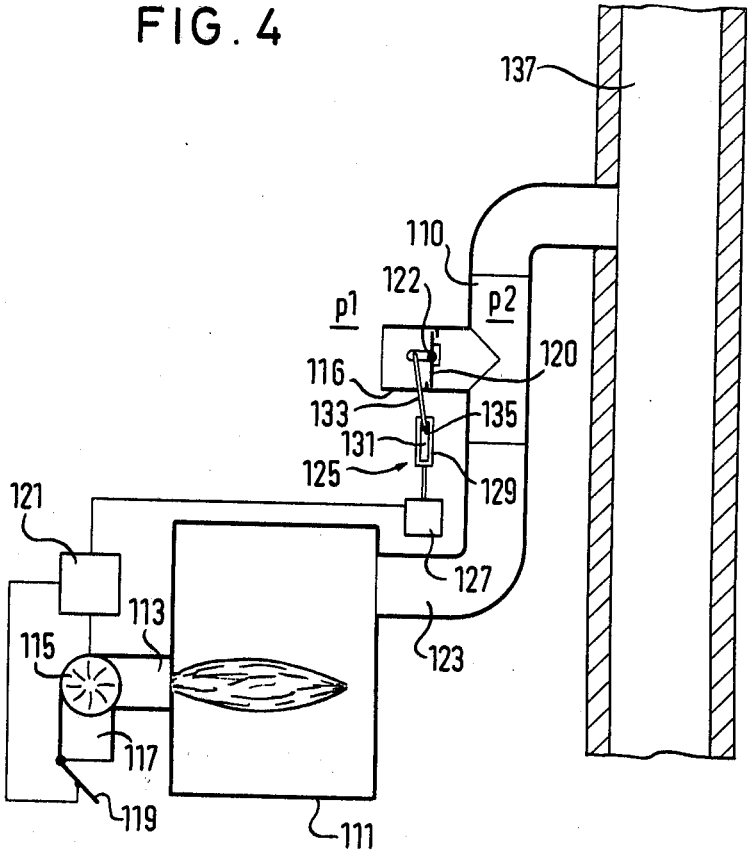
FIG. 4 shows a furnace with a second embodiment of a flap arrangement according to the invention.

In FIG. 4, the boiler of a furnace is designated with 111; the burner of this boiler is designated with 113. It includes a combustion air supply blower 115. In the air in-suction pipe 117 of the combustion air supply blower 115 there is arranged a combustion air flap 119. This combustion air flap 119 is controlled by a control unit 121 of the burner in such a way that shortly before the switching-on of the burner it is opened and is closed upon the inception of an operating pause. An exhaust flap is not provided in the exhaust gas duct 123. In an exhaust pipe section 110 there is arranged a side pipe 116. In this side pipe 116 there is arranged a draft-limiter flap 120 which, in its construction, can correspond to the draft-limiter flap 120 according to FIGS. 1 to 3. The draft-limiter flap 120 is connected via a lost-motion linkage 125 with a drive device 127, for instance an electromotor, which is controlled from the control device 121. The activating linkage 125 comprises a first linkage part 129 with an oblong hole 131 and a second linkage part 133 which is led inside the oblong hole 131 with a sliding head 135. In the position represented in the drawing, the draft-limiter flap 120 is closed. It can open under the action of a pressure difference p1-p2 by pivoting in a clockwise direction around the pivoting axis 122. Such a pivoting opening movement is not prevented by the lost-motion linkage, since the sliding head 135 can slide downwards in the oblong hole 131. So much for the condition of the draft limiter flap during the operation of the furnace. When the furnace is not operating, the combustion air flap 119 is closed by the control device 121 and the linkage part 129 is moved by the motor 127 out of the position according to FIG. 4 into a position located further downwards, so that the sliding head 135 is taken along downwards by the end of the oblong hole 131 and the draft-limiter flap 120, independently of the pressure difference p1-p2, is brought into an open position in which a sufficient ventilation of the chimney 137 is assured.

The combustion air flap 119 is not absolutely necessary. It can be left out in any case then when the inner resistance of the combustion air-exhaust gas duct through the furnace is so great from the entrance of the combustion air pipe 117 to the spot where the draft-limiter flap 120 is located, that during the operating phases with open draft-limiter flap 120, no significant air through-flow through the furnace takes place, that is to say the chimney ventilation takes place substantially over the draft-limiter flap 120.

Figure 5:
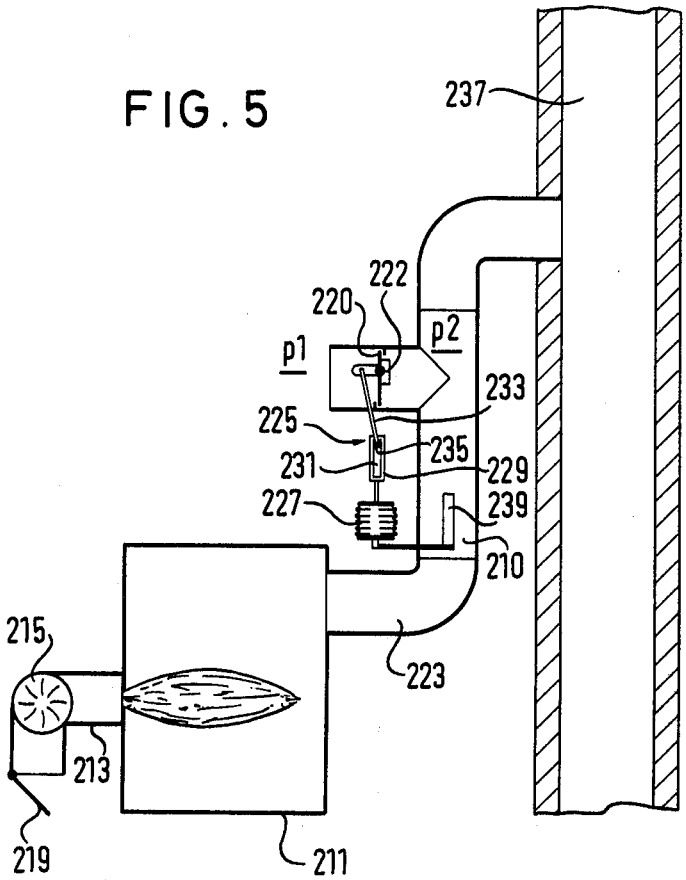
FIG. 5 shows a furnace with a third embodiment form of a flap arrangement according to the invention and FIG. 6 shows the flap arrangement according to FIG. 5 in an enlarged representation.

The embodiment form of FIG. 5 corresponds substantially to that according to FIG. 4. Analogous parts are provided with the same reference signs, as in FIG. 4, respectively increased by the number 100.

By contrast to FIG. 4, the activating device is formed by a pressure box 227 which is connected with a temperature sensor 239. The temperature sensor 239 is arranged in the exhaust gas duct inside the exhaust gas pipe section 210. The transfer mechanism from the pressure box to the draft-limiter flap 220 is the same as in FIG. 4.

Figure 6:
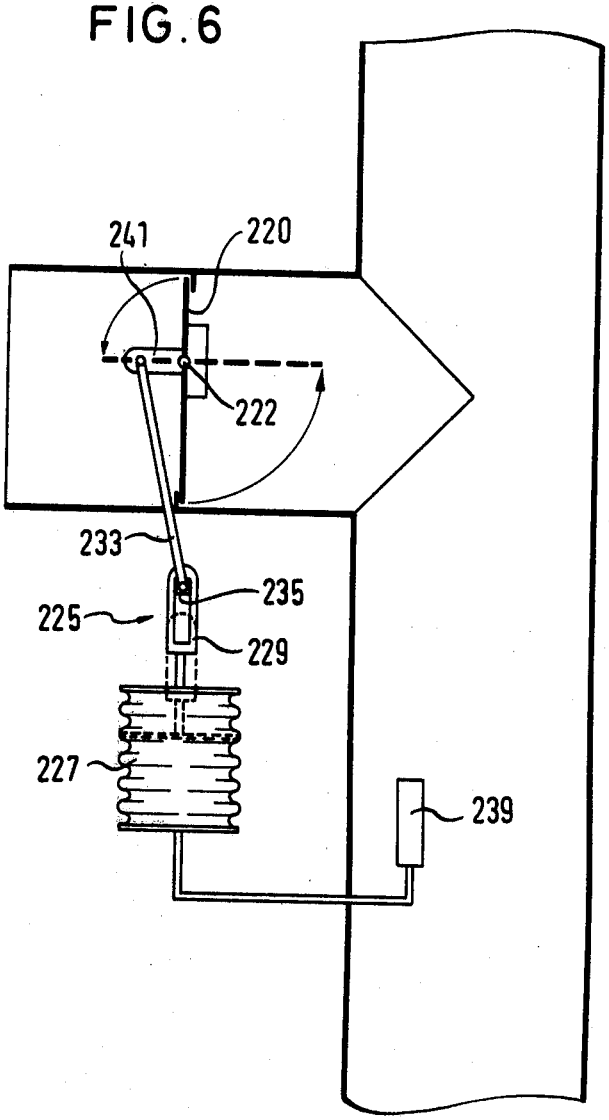

In FIG. 6, the linkage part 233 is connected with a lever 241 which is tightly connected with the draft-limiter flap 220. In broken lines it is also indicated how the pressure box 227 is deformed when the furnace is not operating. Thereat, there takes place an opening of the draft-limiter flap 220.

We claim:

1. Furnace wherein there is connected to the exhaust gas duct after said furnace in the flow direction a ventilation opening with a ventilation flap openable in chronological conjunction with the cut-off of said furnace and closable in chronological conjunction with the switching-on of said furnace, and wherein there is further connected to said exhaust gas duct after said furnace in the flow direction a draft-limiter opening with a draft-limiter flap, whereat said draft-limiter flap is prestressed in the direction of a closing position and is to be opened by the pressure difference incident upon it, p1-p2 (flue draft) between the pressure p2 in said exhaust gas duct and the possibly higher pressure p1 on its outer side, in such a way that when the pressure difference exceeds a predetermined value said draft-limiter flap increasingly opens for the purpose of maintaining a predetermined pressure difference, characterized in that said ventilation opening is formed by said draft-limiter opening (16) and said ventilation flap is formed by said draft-limiter flap (20), whereat said draft-limiter flap (20), during an operating pause of said furnace, is held in an open position independently of said pressure difference (p1-p2) prevailing at said draft-limiter flap (20).

2. Furnace according to claim 1, characterized in that in the arrangement of an exhaust gas flap in said exhaust gas duct, said flap being opened in chronological correlation with the switching-on of said furnace and being closed in chronological correlation with the cut-off of said furnace, said draft-limiter flap (20) can be coupled with said exhaust gas flap (12) in such a way that said draft-limiter flap (20) is held in an open position independently of said pressure difference (p1-p2) prevailing at said draft-limiter flap (20), when said exhaust gas flap (12) is closed.

3. Furnace according to claim 2, characterized in that said exhaust gas flap (12) and said draft-limiter opening (16) along with said draft-limiter flap (20) are combined into one structural unit.

4. Furnace according to claim 2 or 3, characterized in that said draft-limiter opening (16) including said draft-limiter flap (20) is arranged at an exhaust gas pipe section (10) situated in said exhaust gas duct between said furnace and a chimney and which also receives said exhaust gas flap (12).

5. Furnace according to claim 4, characterized in that said draft-limiter flap (20) is arranged in a side pipe (16) projecting from said exhaust gas pipe section (10) substantially perpendicularly to the axis thereof.

6. Furnace according to claim 5, characterized in that said draft-limiter flap (20) is arranged in a housing (18) insertable into said side pipe (16).

7. Furnace according to one of the claims 2 or 3 characterized in that there is affixed to said exhaust gas flap (12) a take-along member (26) which, in the open position of said exhaust gas flap (12) is out of connection with said draft-limiter flap (20) and, upon closing of said exhaust gas flap (12), enters into engagement with said draft-limiter flap (20) and takes said draft-limiter flap along into its open position.

8. Furnace according to claim 7 characterized in that when said exhaust gas flap (12) and said draft limiter flap (20) are mounted around pivoting axles (14,22) parallel to each other, said take-along member of said exhaust gas flap (12) is formed by a take-along arm (26) extending substantially perpendicularly to the plane of said exhaust gas flap (12) and grasping, with its end (30), an edge part (28) of said draft-limiter flap (20) situated far from said pivoting axle (22) of said draft-limiter flap (20), when said exhaust gas flap (12) moves from the open position in the direction of the closing position.

9. Furnace according to one of claims 2 or 3, characterized in that said exhaust gas flap (12) is motor-actuated, for example, by means of an electromotor (32) which, under tension, can constantly be braked to a standstill.

10. Furnace according to claim 9, characterized in that there is arranged a drive unit (32) for said exhaust gas flap (12) at an exhaust gas pipe section (10) receiving said exhaust gas flap (12).

11. Furnace according to one of claims 1, 2 or 3, characterized in that it is equipped with a burner with blower.

12. Furnace according to one of claims 2 or 3, characterized in that said furnace and said exhaust gas duct do not have any flow diverter before said exhaust gas flap (12).

13. Furnace according to one of claims 1, 2 or 3, characterized in that it is operable with liquid or gaseous fuel.

14. Furnace according to one of claims 2 or 3, characterized in that said exhaust gas flap (12) is controlled in correlation with the operative condition of said furnace in such a way that it opens before ignition of a burner of said furnace.

15. Furnace according to one of claims 2 or 3, characterized in that said exhaust gas flap (12) is controlled in correlation with the operative condition of said furnace in such a way that it closes with some delay after the switching-off of a burner of said furnace.

16. Furnace according to one claims 2 or 3, characterized in that said exhaust gas flap (12) closes substantially sealingly in its closed position with respect to said exhaust gas duct.

17. Furnace according to one of claims 2 or 3, characterized in that said exhaust gas flap (12) is adjustable in at least one intermediate position between the closing position and the open position whereat in said intermediate position, said draft limiter flap 20 is not mechanically influenced by said exhaust gas flap (12).

18. Furnace according to one of claims 2 or 3, characterized in that said exhaust gas flap 12 is adjustable in correlation with the temperature in said exhaust gas duct in the sense that when the temperature rises, said exhaust gas flap is adjustable in the direction of the open position.

19. Furnace according to claim 1, characterized in that said draft-limiter flap (120) is coupled with an actuating device (127) controlled in correlation with the operative condition of said furnace (111,113) in such a way that said draft-limiter flap (120) is held, during an operating pause of said furnace, in an open position independently of said pressure difference (p1-p2) prevailing at said draft-limiter flap (120).

20. Furnace according to claim 19, characterized in that said actuating device (127) is controlled by a control device (121) of a burner (113) of said furnace.

21. Furnace according to one of claims 19 or 20, characterized in that said actuating device (127) is an electromotor which, under tension, can constantly be braked to a standstill.

22. Furnace according to claim 19, characterized in that the actuating device (227) is controlled by means of a temperature sensor (239) exposed to the temperature within said furnace (211) or within said exhaust gas duct (223).

23. Furnace according to claim 22, characterized in that said actuating device (227) is a pressure box, the inner pressure of which is controlled by said temperature sensor (239).

24. Furnace according to one of claims 19 or 20, characterized in that said actuating device (227) is connected with said draft-limiter flap (220) over a lost-motion gearing (225).

25. Furnace according to one of claims 19 or 20, characterized in that said furnace (111,113) does not have an exhaust gas flap.

26. Furnace according to claim 25, characterized in that in an intake duct (117) of a burner (113) of said furnace (111) there is provided a combustion air flap (119) which is closed during the operating pause of said furnace and which opens in chronological correlation with the switching-on of said furnace.

27. Furnace according to claim 25, characterized in that in the flapless embodiment of the combustion air-exhaust gas duct (117, 113, 111,123) through said furnace (111) to said chimney (137), the flow resistance of said draft-limiter flap (120) is substantially smaller in the open position brought on during the operating pauses than the flow resistance of said combustion air-exhaust gas duct up to the point of said draft-limiter flap (120).

* * * * *